US006139169A

United States Patent [19]

Caferro

[11] Patent Number: 6,139,169

[45] Date of Patent: Oct. 31, 2000

[54] ENCASED LOUVERS FOR OUTDOOR LIGHTING

[76] Inventor: Ronald N. Caferro, E. 9919 Montgomery, Spokane, Wash. 99206

[21] Appl. No.: 09/283,726

[22] Filed: Apr. 1, 1999

[51] Int. Cl.[7] ..... F21V 11/06

[52] U.S. Cl. ..... 362/291; 362/342; 362/375

[58] Field of Search ..... 362/290, 291, 362/342, 354, 374, 375

[56] References Cited

U.S. PATENT DOCUMENTS

| | | | |
|---|---|---|---|
| 2,398,624 | 4/1946 | Decker | 362/342 |
| 2,971,083 | 2/1961 | Phillips et al. | 240/78 |
| 4,175,281 | 11/1979 | Lonseth | 362/148 |
| 4,222,094 | 9/1980 | Wolar | 362/279 |
| 4,293,901 | 10/1981 | Hernandez | 362/346 |
| 4,379,322 | 4/1983 | Kelly | 362/300 |
| 4,384,318 | 5/1983 | Reibling | 362/216 |
| 4,429,354 | 1/1984 | Garnett | 362/342 |
| 4,621,309 | 11/1986 | Grawe et al. | 362/342 |
| 4,731,714 | 3/1988 | Kelly et al. | 362/310 |
| 5,008,791 | 4/1991 | Caferro | 362/290 |
| 5,586,015 | 12/1996 | Baldwin et al. | 362/263 |

*Primary Examiner*—Stephen Husar

[57] ABSTRACT

A lighting louver mounting case is described for encasing and releasably mounting a lighting louver to an outdoor lighting housing. The case includes a light reflective panel receiving compartment formed by side walls of the case and by substantially transparent bottom and top cover members that enclose and substantially hermetically seal a light reflective panel. A mounting element on the case enables the case to be releasably secured to the outdoor lighting housing.

18 Claims, 7 Drawing Sheets

ENCASED LOUVERS FOR OUTDOOR LIGHTING

TECHNICAL FIELD

The present invention relates to lighting for prescribed areas especially in outdoor environments and particularly to encasement for lighting louvers for use in such environments.

BACKGROUND OF THE INVENTION

Various forms of outdoor lighting are presently used to illuminate relatively small areas such as gas station lots, fast food service facilities, parking lots and foot traffic areas, street lighting, and the like. Lighting for such areas is often provided by lighting fixtures that serve to illuminate the selected areas but also produce glare and unwanted lighting outside such areas. Excessive lighting is an inefficient use of electrical energy at best and can also create a night driving safety hazard for motorists. Excessive lighting can also be an annoyance for residents in close proximity to the light sources.

Many different directional spot lighting fixtures have been produced in attempted solutions to the above problem. However most are provided as perimeter lighting and are effective only when the light fixture can be mounted high above the ground. Highly confined perimeter light distribution also requires numerous expensive fixtures set on poles or other structures that are also expensive to purchase and install.

Lighting in confined, interior spaces is often controlled by the use of parabolic lighting louvers set in panels that are mounted flush with ceiling surfaces or suspended from ceilings. Parabolic louvers are highly effective to evenly disburse light to particular areas from relatively low elevations. Lighting cut-off angles may be accurately controlled and direct glare can be minimized. However, such louvers have not been useful in outside conditions. This is due to the fragile nature of the louvers and the fact that the louver sections cannot be easily cleaned. A coating of dust on the specular finish of parabolic reflectors drastically reduces lighting efficiency. Thus, though the highly efficient and desirable parabolic louver panels are widely known in the interior lighting industry, similar panels adapted for exterior lighting have not been available.

It is an objective of the present invention to provide an encased lighting louver that will facilitate adaptation to outdoor lighting by providing encasement for the louver.

Another object is to provide such a louver that will provide the advantages of parabolic louver lighting, but that will protect and eliminate the need to clean the louver surfaces in outdoor installations.

A further objective is to provide an outdoor lighting housing that is particularly suited to mount lighting louvers of conventional indoor configuration.

These and further objectives and advantages may become apparent from the following description.

BRIEF DESCRIPTION OF THE DRAWINGS

Preferred embodiments of the invention are described below with reference to the following accompanying drawings.

FIG. 1 is a schematic view illustrating several mounting situations that may be used with the present encased louver arrangement;

FIG. 4 is a view similar to FIG. 2 only showing a flush mount configuration for the present invention;

FIG. 7 is a diagrammatic view illustrating exemplary light distribution through parabolic louvers.

DETAILED DESCRIPTION OF THE PREFERRED EMBODIMENTS

Figure 11:
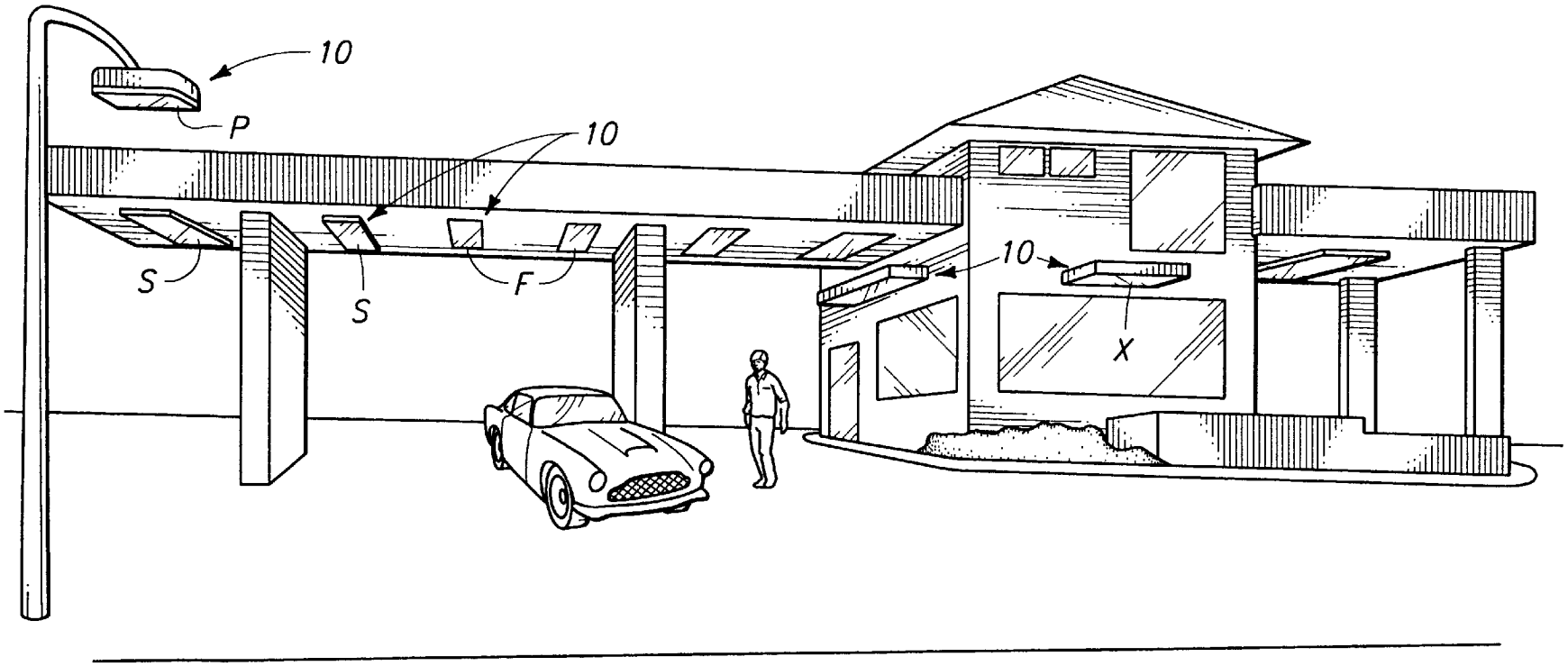

This disclosure of the invention is submitted in furtherance of the constitutional purposes of the U.S. Patent Laws "to promote the progress of science and useful arts" (Article 1, Section 8).

FIG. 1 of the drawings diagrammatically illustrates a installation in which the present invention may be effectively used. There, a building structure is shown and a surrounding area that is advantageously illuminated by variations of the present invention which are generally designated with the reference numeral 10. Both surface mount and suspended versions of the present lighting arrangement are illustrated, all of which include common features of the present invention.

In preferred embodiments (FIGS. 2–6), an encased parabolic lighting louver 12 is shown in which a light reflective panel 14 formed of parabolic louver sections 16 arranged in a selected pattern with at least some louver sections including selected reflective surface configurations configured to produce a specific light distribution curve.

The preferred light reflective panel 14 includes a top surface 18 and a bottom surface 20. Light transmissive cells 22 are defined by the louver sections 16. The cells 22 extend between the top and bottom surfaces 18, 20 and are disposed between the parabolic louver sections. The cells 22 are open at the top and bottom surfaces 18, 20.

A case 30 encloses and substantially hermetically sealing the light reflective panel 14. The case 30 is preferably constructed at least partially of an appropriate plastic material and includes a light reflective panel receiving compartment 32. The compartment 32 is formed by a substantially transparent bottom cover member 34, a top cover member 35, and peripheral side walls 37 joining the top and bottom cover members 35, 34.

The light reflective panel 14 is disposed within the case 30. The bottom surface 18 of the panel and open bottom ends of the light transmissive cells 22 are situated adjacent the transparent bottom cover member of the case 30. The panel top surface 18 is located within the compartment adjacent the top cover member 35.

A mount 50 on the case 30 is configured for attachment to a light source housing 60 to position the top cover member 35 of the case outwardly adjacent to a light source 70 within the housing 60. The reflective panel 14 may thus be hermetically isolated and sealed from the environment yet held by the mount structure 50 adjacent the light source to effectively control emissions from the light source.

In preferred embodiments, a combination is comprised of the above exemplary elements including the light source housing 60. Here the light source housing is configured to internally mount the source of illumination 70 and extends to an open end 62. The present case 30 and mount 50 in this embodiment includes a seal surface 47 that is used in conjunction with the mount 50 to hermetically seal the case 30 to the light source housing 60. Thus the entire light source housing 60 may be hermetically sealed yet the light source 70 is accessible simply through operation of the mount 50.

Various elements of the preferred embodiments will now be discussed in greater detail under separate sub-headings.

The Louver 12

Figure 2:
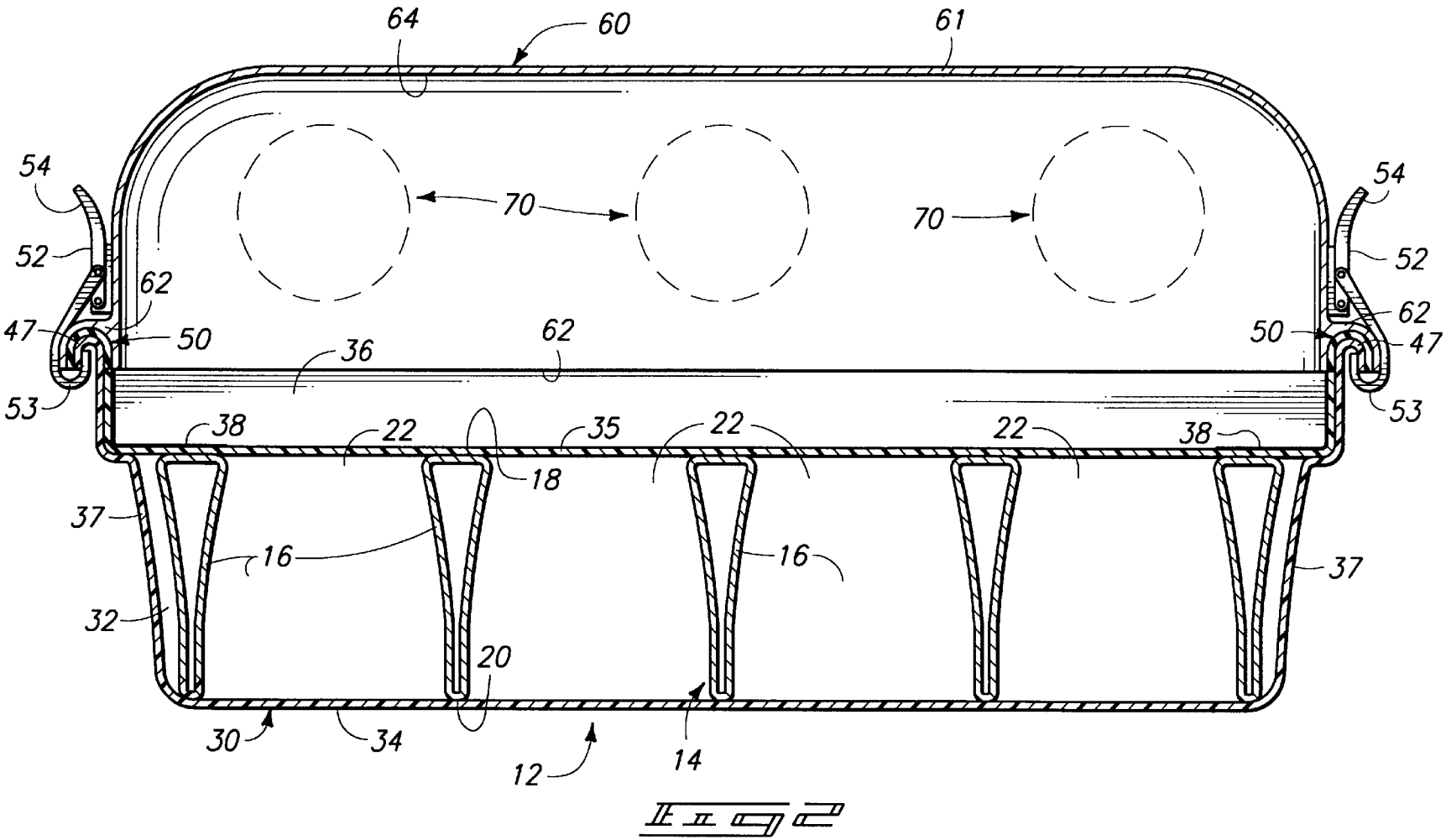
FIG. 2 is a sectional view through a lighting fixture incorporating features of the present invention.
Figure 3:
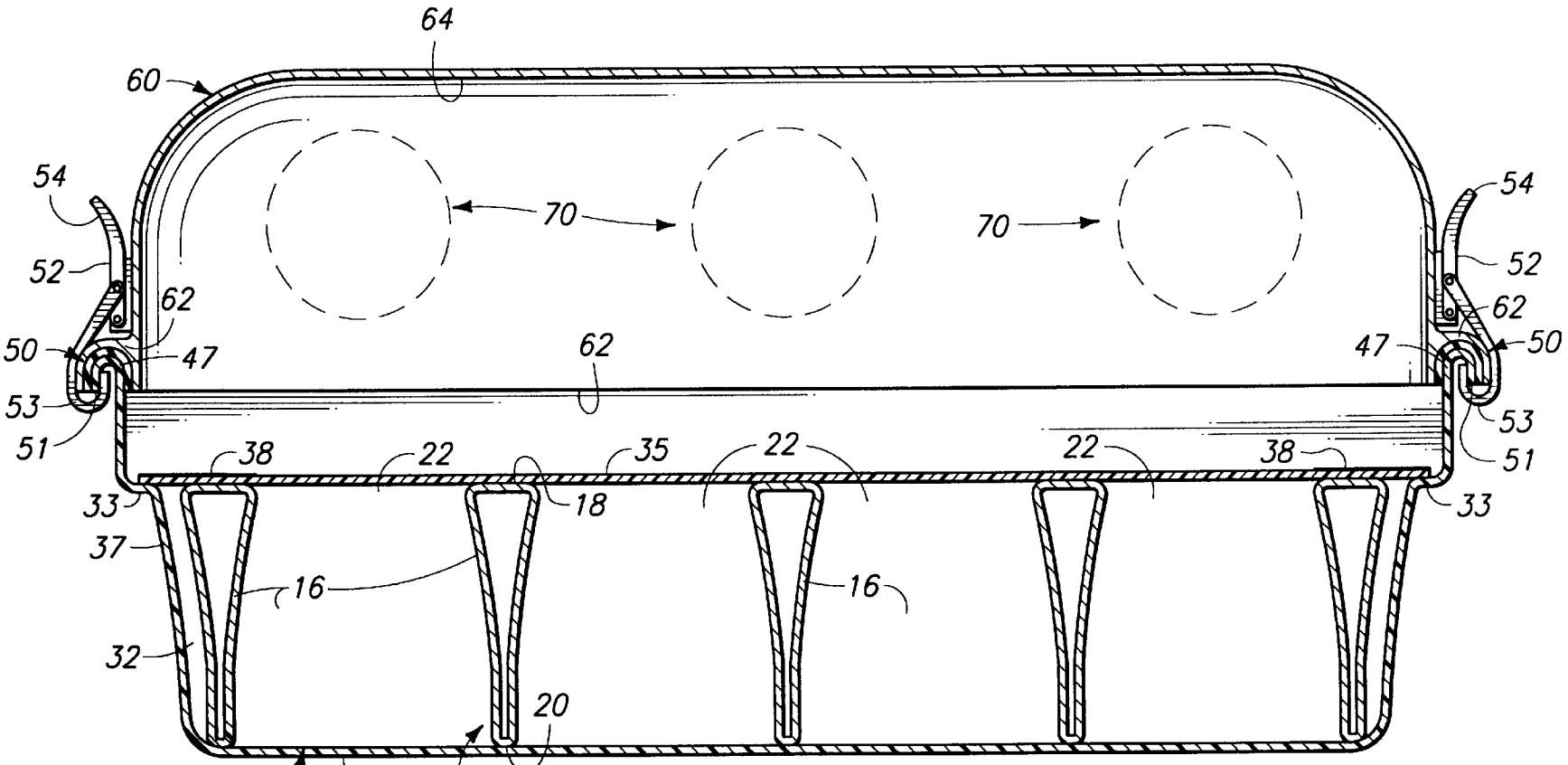
FIG. 3 is a view similar to FIG. 2 only showing a variation of components structure.
Figure 2A:
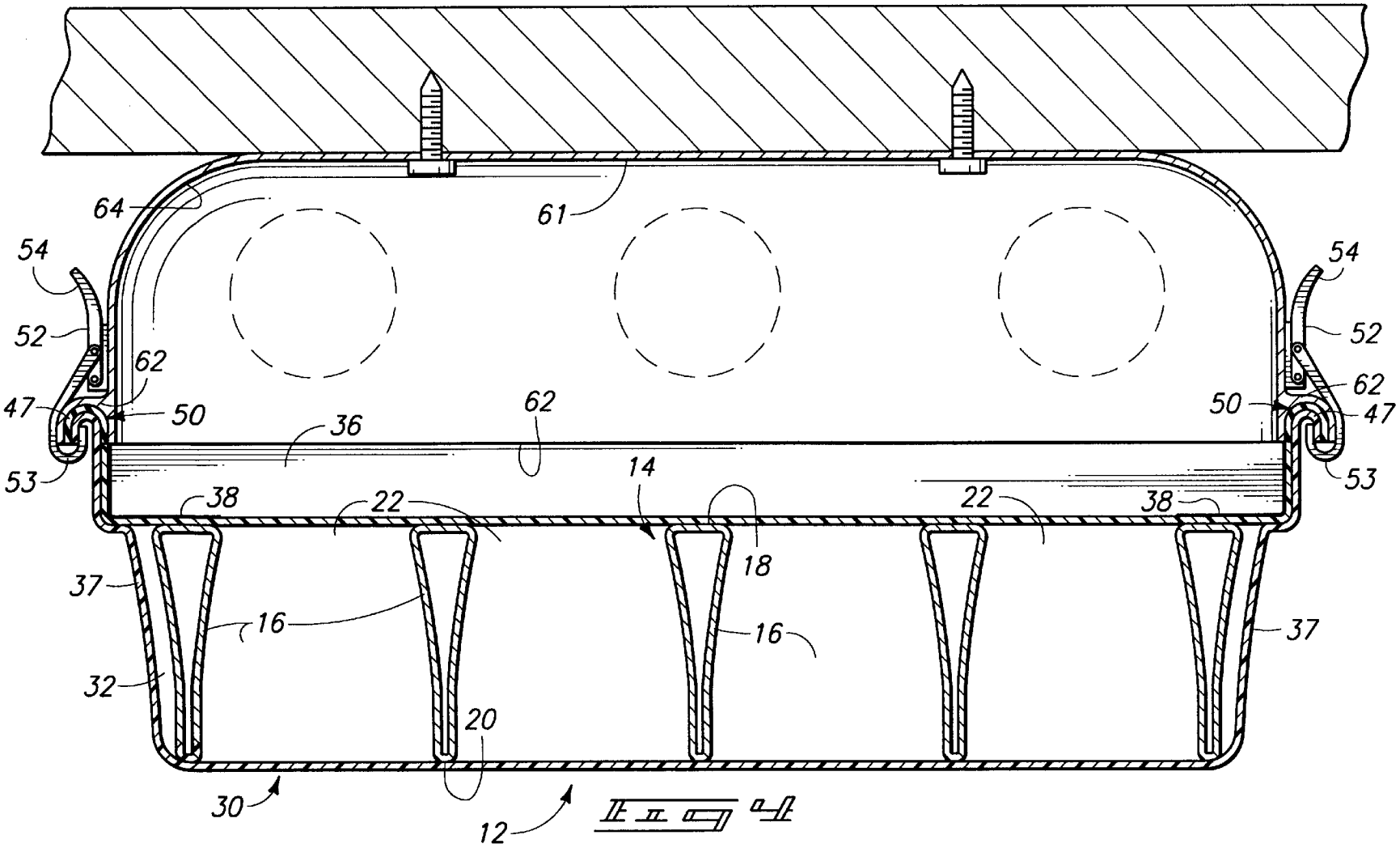

FIGS. 2–4 illustrate the louver 12 in the parabolic light reflective panel configuration 14. In preferred forms, the panel 14 is made up of louver sections 16 that are arranged in a substantially rectangular grid configuration that in one preferred form is comprised of cross-oriented parabolic louver sections.

In the exemplified forms, the louver sections 16 cross one another at approximately 90° angles, thus forming substantially rectangular cells 22 through which light may pass. FIG. 7 is provided to illustrate a light distribution cut-off characteristic common to parabolic louvers. Particular parabolic curvatures of the louver sections may be calculated in a manner similar if not identical to procedures and construction techniques used for indoor lighting.

In fact it is quite possible and may be desirable to select a particular parabolic louver panel that might otherwise be used for indoor lighting. Use of such louver panels is entirely possible in the present combination, and in fact such feature significantly contributes to the utility of the present invention by enabling use of existing louver construction and extending utility of such construction to outdoor lighting situations.

Examples of a louver construction that may be useful in the present combination is disclosed in U.S. Pat. No. 5,008,791 granted Apr. 16, 1991 to the present Applicant, Ronald N. Caferro; U.S. Pat. No. 4,429,354 granted Jan. 31, 1984 to Garnett; and U.S. Pat. No. 4,222,094 granted Sep. 9, 1980 to Wolar. Relevant portions of these patents are hereby incorporated by reference in the present application. Of course other conventional or non-conventional louver configurations and materials may also be used.

Figure 6:
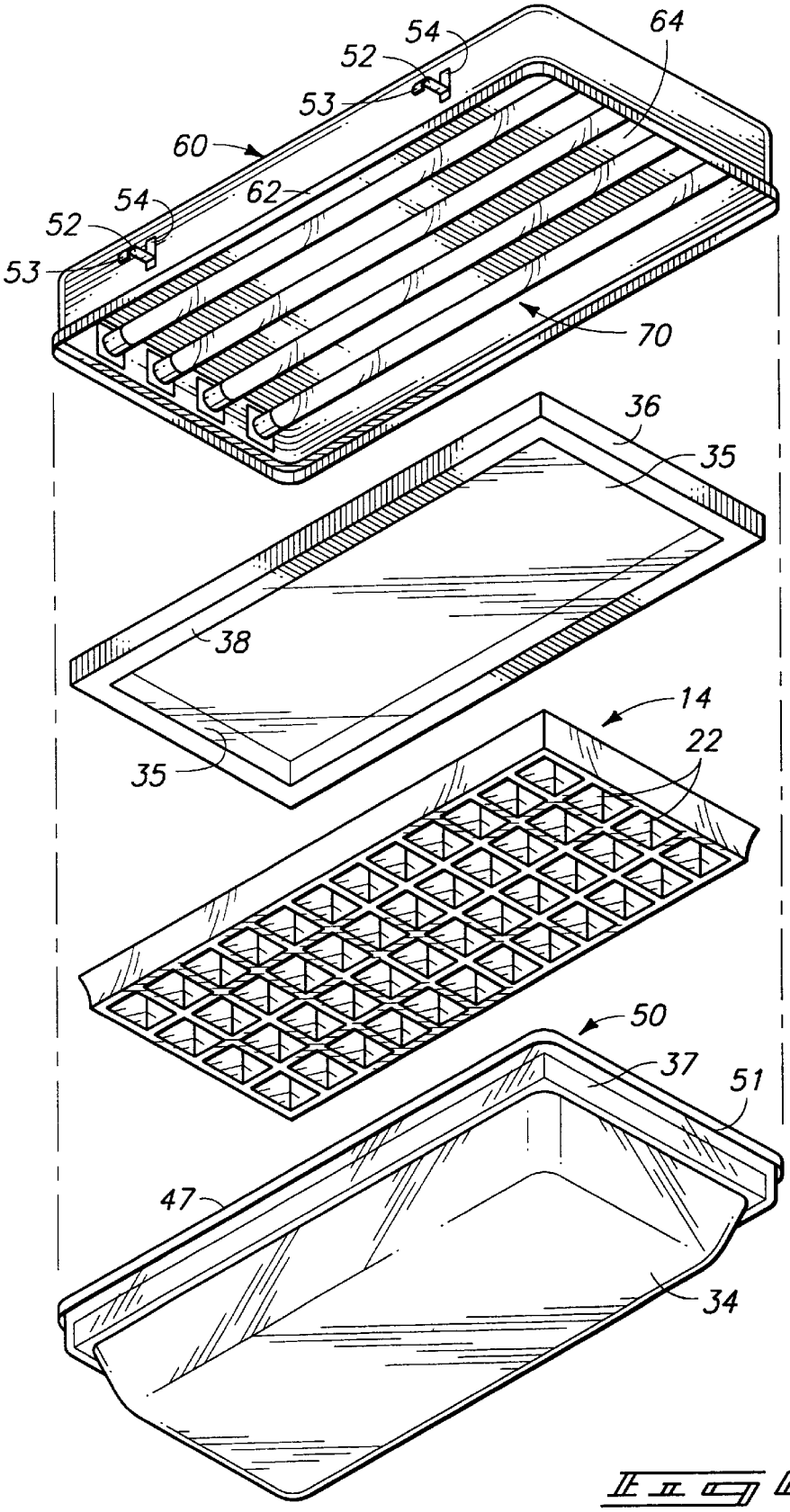
FIG. 6 is an exploded perspective view.
Figure 11:
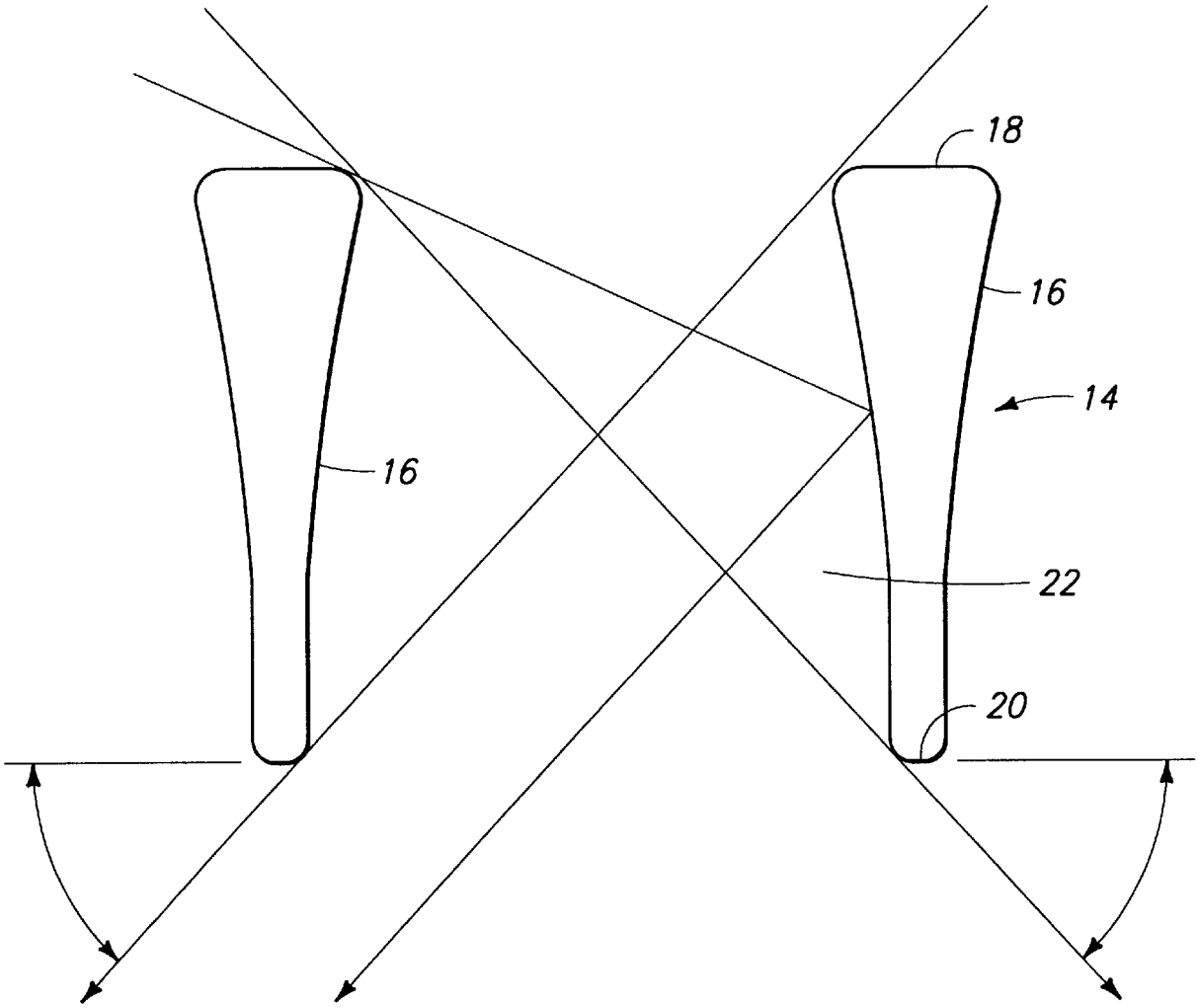

It is pointed out that the configuration of the louver panel may be rectangular, curved or otherwise shaped according to need. It is also pointed out that the orientation of the louver sections may be intersecting as shown by FIG. 6, forming rectangular cells 22, or other configurations may be utilized. For example, parallel sections could be used in which the cells would be elongated. Further, the sections could be made to radiate from a chosen center wherein the cells would be substantially triangular. Still further, the sections could intersect at other than 90° angles so the cells would take on other geometric forms such as parallelograms, trapezoids, hexagons, octagons, or other configurations. The presently preferred configuration, however is a rectangular pattern as exemplified by FIG. 6.

It is preferred that the panel bottom and top surfaces 18, 20 be parallel, though such is not required. Parallel surfaces 18 and 20 are simply preferred for convenience of louver construction and to minimize the overall thickness requirement for the case compartment 32 in which the panel is sealed.

Preferred individual louver sections 16 are formed of specular aluminum, a material commonly used in formation of conventional indoor lighting louvers. In fact, as implied above, the aluminum material may be selected from the same known materials used to produce indoor parabolic lighting louvers. Given the commonality of construction technique and materials, selection of light distribution curves may be effectively determined using conventional techniques, with cut-off angles (see example in FIG. 7) determined by the particular requirements of a given installation.

Case 30

As briefly outlined above, the case 30 is formed to mount and hermetically seal a louver 12 and includes further provisions to facilitate positioning of the louver adjacent the light source 70. Thus the case 30 may be formed in different configurations. The preferred example illustrated in the drawings is a basic rectangular configuration, to accept relatively standard rectangular louver panel shapes. However other configurations could be made without changing the nature of the components described below.

It is also pointed out that the case 30 may be manufactured as a subcombination and supplied separately from the louver 12. A separate louver may be installed, say, by a louver manufacturer following purchase of the case 30. It is also possible to manufacture and distribute a combination in which the louver 12 and case 30 will be supplied together for later assembly with a light source housing 60. Still further, it is possible to manufacture and distribute the combination in which the louver 12, case 30 and light source housing 60 are supplied together.

Details of preferred case configurations are illustrated in FIGS. 2–4. In the preferred embodiments illustrated, the case 30 includes the bottom cover 34 and integral peripheral side walls 37. The bottom cover 34 is preferably transparent, or at least translucent to permit passage of light. It is also possible to construct the walls 37 of the same transparent material. In doing so a substantial portion of the case may be formed of a single sheet of appropriate plastic material by thermoforming, injection molding or other appropriate plastic forming techniques. Thus it may be that the peripheral side walls 37 are also transparent.

Normally, transparent side walls 37 would be undesirable. It is normally undesirable for light be directed outwardly through the side walls 37. However, with the present construction, the walls 37 will come in close proximity to the louver sections 16 at the perimeter of the panel, so minimal light will be transmitted to the walls. Nonetheless it is preferable to coat the side walls with opaque material such as paint, die, opaque tape, or another appropriate coating to render the side walls opaque.

The bottom transparent cover 34 is configured, as shown in FIGS. 2 and 3, to engage and support the louver panel 12 at its bottom surface 20. Thus the panel 20 may rest loosely against the bottom cover and not require further support by attachment to the side walls 37. The panel 14 is simply sandwiched within the compartment 42 between the bottom cover 34 and the top cover 35.

The top cover 35 is preferably fitted to engage or come into close approximation to the top surface 18 of the louver panel 14 when mounted within the case 30. The top cover 35 as shown in FIGS. 2–4 and 6 may be formed of the same material as the bottom cover 34, and be configured to mount in flush engagement with the side walls 37.

The top cover 35 is preferably shaped to be secured in sealed relation to the case 30 by adhesive, caulk, gaskets or the like, thereby completing and closing and hermetically sealing the louver receiving compartment 32.

The top cover member 35 advantageously includes a flange 36 that is formed about the cover perimeter, and that is configured to mate with the case side walls 37. The flange 36 may be secured by adhesive or a sealant material to the case side walls 37, thereby hermetically sealing the louver receiving compartment 32.

FIG. 3 illustrates an embodiment in which the top cover 35 is planar and does not include a marginal flange. Instead, the flat cover is provided to rest against a formed peripheral shoulder 33. Appropriate adhesive or sealing material may be used between the engaged surfaces to provide the hermetic seal.

Like the bottom cover 34, the top cover member 35 is preferably transparent. However, an area about the perimeter of the cover may be painted, taped, or otherwise made opaque as shown in FIG. 6. The opaque area 38 is disposed on the top cover member 35 to prevent light from entering the area between the perimeter of the panel and the case side walls 37.

Figure 5:
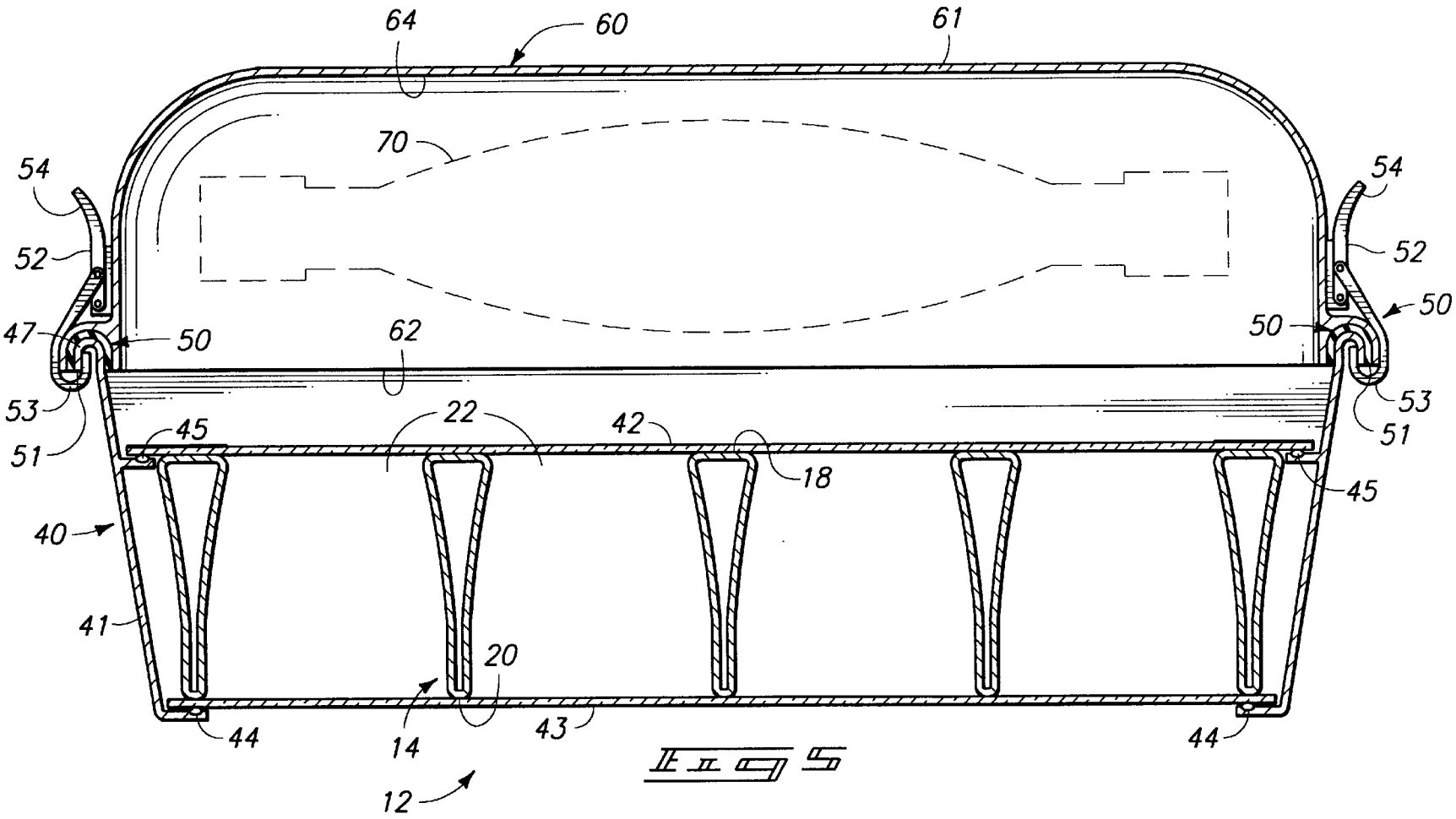
FIG. 5 is a sectional view of an embodiment making use of a case with separate wall and bottom cover elements.

In the embodiment shown by FIG. 5, a case 40 is provided with side walls 41 that are formed separately from individual top and bottom covers 42, 43. In this embodiment, the sidewalls 41 may be formed of injection molded plastic, formed metal (cast, stamped, or otherwise fabricated), and the covers 42, 43 may be formed of transparent glass. A perimeter seal 44 (such as a rubber "O-ring") is preferably situated between the bottom cover 43 and the side walls 41. A similar seal 45 may be positioned between the top cover 42 and side walls 41 to effectively hermetically seal the louver receiving compartment 46.

In the preferred embodiments illustrated, the seal surface 47 is provided on the peripheral side walls 37 or 41 of either case embodiment to produce a hermetic seal with the light source housing 60. This seal may be formed integrally with the side walls, and fit within a complimentary groove or recess formed about the light source housing 60. It may be preferable to include another "O-ring" gasket between the case seal surface 47 and the light source housing 60 in order to prevent any accumulation of dust or moisture within the housing 60.

Light Source Housing 60

The light source housing 60 may take any of several forms, as generally illustrated in FIG. 1 of the drawings. In broad terms, the housing 60 will include a housing base 61 that includes an open bottom end 62. The open bottom end 62, as described above is preferably configured to mate with the seal surface 47 on the peripheral side walls of the case 30.

The case 30 may be made to fit an existing light fixture housing simply by configuring the seal surface 47 to match that of a particular housing. Alternatively, both elements (case 30 and housing 60) may be made specifically to fit together. In either configuration, it is preferred that the case be removable from the housing 60 for cleaning, maintenance, and to enable changing of lamps within the housing.

The housing 60 may be formed by known lighting fixture construction techniques depending upon particular needs. Thus the housing may be produced of metal, by known forming apparatus and processes. Alternatively the housing could also be produced in plastic, also formed by known processes and equipment.

Preferred forms of the housing 60 will include conventional internal components used to mount and conduct electrical energy to one or more light sources 70. Various forms of conventional light sources may be used, including but not limited to incandescent bulbs, fluorescent tubes, or high intensity discharge lamps. The selected light source 70 and attendant mounting structure will be secured within the housing 60 in such a manner that the light source 70 will be situated inwardly adjacent the open bottom end 62 of the housing 60 and outwardly adjacent the top cover member 35 of the present case 30.

Inner parts of the housing may be supplied with appropriate reflective surfaces 64 (FIGS. 2–4 and 7) to direct light toward the open bottom end 62 and the louver panel 14. Such surfaces 64 may simply be light colored reflective surfaces that are integral with the housing, as found in many fluorescent fixtures; or specifically configured specular reflectors that are also commonly known in the lighting industry.

As may be noted in FIG. 1, the housing may be mounted to a support structure in any of several ways. FIG. 1 shows the housing in a post or pole mount configuration P, in a manner similar to conventional street lighting. Ceiling mounted housing configurations are also shown, including flush mount configuration F (also see FIG. 4) and surface mount configuration S. It is also possible to provide the present housing structure in a vertical surface mount configuration V. Standard mounting hardware may be adapted for each of the above mounting configurations.

Mount 50

The mount element 50 in preferred forms is integral with the peripheral side walls to facilitate connection of the case 30 to the light source housing 60. In a preferred form, the mount element 50 is comprised of a flange, which preferably is an integral hooked edge 51 of the seal 47, on at least one of the peripheral side walls of the case. Most preferably, the flange extends about the periphery of the case, enabling grasping by latch mechanisms 52 provided on the light source housing 60. As an alternative, however, it is possible to mount latch mechanisms 52 on the case for interaction with appropriate catch surfaces (not shown) on the source housing.

The latch mechanisms 52 may be comprised of over-center hook arrangements of the type used in other light fixtures for securing lenses or louvers to light housings. In an exemplified mechanism 52, a hook member 53 is attached by a lever 54 that is pivoted to the housing. The hook member may be fitted over the flange edge 51 and the lever 54, when pivoted upwardly, pulls the hook 53 and case 30 upwardly to seat firmly against the open bottom end of the housing. The lever will pivot to a closed over-center position, holding the hook member in the raised, clamping position thereby firmly but releasably securing the case to the light source housing.

Operation

Operation of the present louver assembly is similar to indoor louvers, with the exception that the louver panel is sandwiched between the top and bottom transparent covers 34, 35. Light from source 70 will pass through the top cover 35, be reflected in a controlled manner by the louver sections 16, and pass through the bottom cover 34 to the environment. The louver sections will effectively control distribution of light so that the area to be lighted will be illuminated but adjacent areas will remain relatively dark.

The louver panel 14, being hermetically sealed within the compartment 32 will remain clean and unaffected by weather, dust or insects. The covers will also help to protect the louver panel from deformation from by physical impact by foreign objects.

The mount 50 facilitates access to the light housing and light source 70 by allowing detachment of the case 30 from the light fixture housing 60. Simple operation of the levers 54 will disengage the hooks 53 and allow the case 30 to be removed from the housing 60. The case may be re-attached by simply holding the perimeter seal 44 in position against the open bottom end of the housing base 61. The hooks may then be engaged over the latch edge 51 and lifted to pull the case firmly against the housing bottom.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An encased parabolic lighting louver for attachment to a light source housing, comprising:

a light reflective panel formed of parabolic louver sections arranged in a selected pattern with at least some louver sections including selected reflective surface configurations configured to produce a specific light distribution curve;

wherein the light reflective panel includes a top surface and a bottom surface and defines light transmissive cells extending between the top and bottom surfaces and disposed between the parabolic louver sections, said cells opening at the top and bottom surfaces;

a case enclosing and substantially hermetically sealing the light reflective panel and including a light reflective panel receiving compartment formed by a substantially transparent bottom cover member, a top cover member, and peripheral side walls joining the top and bottom cover members;

wherein the light reflective panel is disposed within the case with the bottom surface of the panel and light transmissive cells adjacent the transparent bottom cover member of the case; and a mount element on the case configured for attachment to a light source housing to position the top cover member of the case outwardly adjacent to a light source within the housing whereby the reflective panel is isolated and substantially sealed from the environment yet held by the mount element adjacent the light source to control emissions from the light source.

2. An encased parabolic lighting louver as defined by claim 1 wherein the parabolic louver sections are arranged in a substantially rectangular grid configuration.

3. An encased parabolic lighting louver as defined by claim 1 wherein the parabolic louver sections are formed of specular aluminum.

4. An encased parabolic lighting louver as defined by claim 1 wherein the peripheral side walls of the case are at least substantially opaque.

5. An encased parabolic lighting louver as defined by claim 1 wherein the bottom surface of the light reflective panel rests against the transparent bottom cover member of the case.

6. An encased parabolic lighting louver as defined by claim 1 wherein the mount element is comprised of a flange on at least one of the peripheral side walls of the case.

7. An encased parabolic lighting louver as defined by claim 1 wherein the top cover member of the case is transparent and the peripheral side walls are opaque and integral with the bottom cover member.

8. An encased parabolic lighting louver as defined by claim 1 wherein the peripheral side walls and transparent bottom cover member of the case are integral, and wherein the mount element is integral with the peripheral side walls.

9. An encased parabolic lighting louver as defined by claim 1 wherein the mount element is integral with the peripheral side walls, and further comprising a seal surface on the peripheral side walls configured to produce a hermetic seal with the light source housing.

10. An encased parabolic lighting louver as defined by claim 1 wherein the top and bottom cover members are substantially parallel to the respective top and bottom surfaces of the light reflective panel.

11. A light fixture, comprising:

a light source housing configured to internally mount a source of illumination;

the light source housing including an open end;

a light reflective panel formed of parabolic louver sections arranged in a selected pattern with at least some louvers including selected specular surfaces configured to produce a selected lighting distribution;

wherein the light reflective panel defines open light transmissive cells between the parabolic louver sections;

a case enclosing and substantially hermetically sealing the light reflective panel and including a light reflective panel receiving compartment formed by a substantially transparent bottom cover member, a top cover member, and peripheral side walls joining the top and bottom cover members; and a mount operatively disposed between the case and light source housing and operable to releasably secure the case to the light source housing at the open end thereof.

12. The light fixture as defined by claim 11, wherein the light reflective panel is formed of cross-oriented parabolic louver sections.

13. The light fixture as defined by claim 11, wherein the light reflective panel is formed of specular aluminum cross-oriented parabolic louver sections.

14. The light fixture as defined by claim 11, wherein the side walls of the case are substantially opaque.

15. The light fixture as defined by claim 11, wherein the side walls of the case are integral with the bottom wall, and wherein the top wall of the case is transparent and covers the light reflective panel.

16. The light fixture as defined by claim 11, wherein the top wall of the case spans the light reflective panel and is in sealed engagement with the peripheral side walls.

17. The light fixture as defined by claim 11, further comprising a seal between the mount structure and the housing.

18. A lighting louver mounting case for encasing and releasably mounting a lighting louver to an outdoor lighting fixture, comprising:

a case configured to enclose and substantially hermetically seal a light reflective panel formed of parabolic louver sections;

wherein the case includes a light reflective panel receiving compartment formed by a substantially transparent bottom cover member, a top cover member, and peripheral side walls joining the top and bottom cover members;

a mounting element on the case configured to enable the case to be releasably secured to a light source housing.

* * * * *